US006109731A

United States Patent [19]

Van Gemert et al.

[11] Patent Number: 6,109,731

[45] **Date of Patent: *Aug. 29, 2000**

[54] DEVICE FOR DIRECT ELECTROSTATIC PRINTING WITH A CONVENTIONAL PRINTHEAD STRUCTURE AND AC-COUPLING TO THE CONTROL ELECTRODES

[75] Inventors: Danny Van Gemert, Hulshout; Raf Peymen, Lommel; Jacques Leonard, Antwerpen; Hilbrand Van Den Wijngaert, Grobbendonk; Guido Desie, Herent, all of Belgium

[73] Assignee: Agfa-Gevaert N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 09/175,259

[22] Filed: Oct. 20, 1998

Related U.S. Application Data

[60] Provisional application No. 60/071,642, Jan. 16, 1998.

[30] Foreign Application Priority Data

Oct. 20, 1997 [EP] European Pat. Off. ..... 97203268

[51] Int. Cl.[7] ..... B41J 2/06

[52] U.S. Cl. ..... 347/55

[58] Field of Search ..... 347/55, 141, 103, 347/151, 154, 120, 123, 111, 127, 128; 399/271, 290, 292, 293, 294, 295

[56] References Cited

U.S. PATENT DOCUMENTS

| | | | |
|---|---|---|---|
| 3,689,935 | 9/1972 | Pressman et al. . | |
| 4,478,510 | 10/1984 | Fujii et al. . | |
| 4,491,855 | 1/1985 | Fujii et al. . | |
| 4,903,050 | 2/1990 | Schmidlin . | |
| 5,036,341 | 7/1991 | Larsson . | |
| 5,095,322 | 3/1992 | Fletcher . | |
| 5,233,392 | 8/1993 | Kitamura . | |
| 5,374,949 | 12/1994 | Wada et al. . | |
| 5,526,029 | 6/1996 | Larson et al. . | |
| 5,708,464 | 1/1998 | Desie | 347/55 |

FOREIGN PATENT DOCUMENTS

| | | |
|---|---|---|
| 0266960 | 10/1987 | European Pat. Off. . |
| 0715218 | 6/1996 | European Pat. Off. . |
| 0720072 | 7/1996 | European Pat. Off. . |
| 9104863 | 4/1999 | WIPO . |

*Primary Examiner*—John Barlow
*Assistant Examiner*—Raquel Yvette Gordon
*Attorney, Agent, or Firm*—Baker Botts L.L.P.

[57] ABSTRACT

A direct electrostatic printing device includes a printhead structure with apertures and control electrodes associated with the apertures for delivering toner from a toner source to a substrate in accordance with image data. A first voltage source is provided to establish a flow of toner particles from the toner source to the substrate. A second voltage source is provided to establish a control voltage between the toner source and the control electrodes to control toner flow in accordance with the image data. The second voltage source provides a first AC field between a toner source and the control electrodes to permit toner flow and a second, diminished, AC field between the toner source and the control electrodes in order to stop the toner flow.

6 Claims, 7 Drawing Sheets

DEVICE FOR DIRECT ELECTROSTATIC PRINTING WITH A CONVENTIONAL PRINTHEAD STRUCTURE AND AC-COUPLING TO THE CONTROL ELECTRODES

This application claims benefit of Provisional Appl. 60/071,642 filed Jan. 16, 1998.

FIELD OF THE INVENTION

This invention relates to a method and an apparatus used in the process of electrostatic printing and more particularly in Direct Electrostatic Printing (DEP). In DEP, electrostatic printing on an image receiving substrate is performed by creating a flow of toner particles from a toner bearing surface to the image receiving substrate and image-wise modulating the flow of toner particles by means of an electronically addressable printhead structure.

BACKGROUND OF THE INVENTION

In DEP (Direct Electrostatic Printing) the toner or developing material is deposited directly in an image-wise way on a receiving substrate, the latter not bearing any image-wise latent electrostatic image. The substrate can be an intermediate endless flexible belt (e.g. aluminium, polyimide etc.). In that case the image-wise deposited toner must be transferred onto another final substrate. Preferentially the toner is deposited directly on the final receiving substrate, thus offering a possibility to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935 This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected electric potentials (only DC-potentials) are applied to each of the control electrodes while a fixed potential is applied to the shield electrode. An overall applied propulsion field between a toner delivery means and a support for a toner receiving substrate projects charged toner particles through a row of apertures of the printhead structure. The intensity of the particle stream is modulated according to the pattern of potentials applied to the control electrodes. The modulated stream of charged particles impinges upon a receiving substrate, interposed in the modulated particle stream. The receiving substrate is transported in a direction orthogonal to the printhead structure, to provide a line-by-line scan printing. The shield electrode may face the toner delivery means and the control electrodes may face the receiving substrate. A DC-field is applied between the printhead structure and a single back electrode on the receiving substrate. This propulsion field is responsible for the attraction of toner to the receiving substrate that is placed between the printhead structure and the back electrode.

A DEP printer wherein the printhead structure is a mesh instead of a insulating base with printing apertures trough this base has been disclosed in U.S. Pat. No. 5,036,341. In this disclosure it is taught to introduce an AC-field with frequency between 2 and 5 kHz and peak voltages between 500 and 2000 V on the toner delivery means in order to speed up the printing.

One of the recognised problems with both of these types of printhead structures, the printing apertures are easily clogged by toner particles when the DEP device is used over a longer period of time.

This problem of clogging of the printing apertures has been addressed in several ways. In e.g. U.S. Pat. No. 4,491,855 different measures are disclosed to minimise clogging. It is proposed in this disclosure to provide a conveying member on which a layer of toner particles is deposited and to apply an AC voltage (300 V peak to peak and frequency of 4.5 kHz) between the toner conveying member and the continuous layer of conductive material (shield electrode) on the printhead structure. Due to this AC voltage the toner particles "jump" between the toner conveying member and the surface of the printhead facing said toner conveying member. It is believed that the "touching" toner particles will assist in delaying the contamination of the printhead structure and clogging of the apertures. In this disclosure also a special design of the apertures in the printhead structure and a special selection of the material from which the printhead structure is made is also claimed to assist in delaying the clogging. A last measure which is proposed is to 'clean' the printhead structure by periodical electric bursts (spark discharges). Also in U.S. Pat. No. 4,478,510 the use of a spark discharge to remove toner particles adhered to the printhead is disclosed.

In U.S. Pat. No. 4,876,561 clogging of the printhead is prevented by making the apertures large enough and/or the thickness of the isolating layer small enough.

In U.S. Pat. No. 4,903,050 an AC voltage is applied to the back electrode as in U.S. Pat. No. 4,755,837, but this disclosure recommends the addition of a shutter and vacuum system is in order to prevent the dislodged toner to fall onto the receiving substrate.

In U.S. Pat. No. 5,095,322 clogging of the apertures is prevented by applying to the shield electrode a pulsed DC-voltage which is 180° out of phase if compared with the AC-voltage applied to the charged toner conveyor. In an other embodiment a DC-biased AC voltage is applied to the shield electrode with the same frequency as the AC voltage applied to the charged toner conveyor but 180° out of phase is used to prevent clogging of the apertures in the printhead.

Also mechanical ways to prevent clogging or to clean the printing apertures have been disclosed. In, e.g., U.S. Pat. No. 5,153,611, U.S. Pat. No. 5,202,704, U.S. Pat. No. 5,233,392 it is disclosed to prevent clogging of the printing apertures by using an ultrasonic vibration applied to the printhead. In U.S. Pat. No. 5,283,594 the level of vibration applied to the printhead is different during writing time and cleaning time. In U.S. Pat. No. 5,293,181 the printhead is vibrated in such a way that a mechanical propagating wave is created.

In U.S. Pat. No. 5,307,092 an anti-static coating is applied to the electrodes in the printhead so that any tribocharge that accumulates during writing can be grounded. As a result the net tribocharge on the printhead (which is unwanted and is responsible for unpredictable results and clogging) is removed and a better long-time performance results.

In WO-A-90 14959 the printhead is treated with pressurised air or vacuum so that the individual toner particles do not adhere to the printhead for such a large amount if compared with a printing engine not using the air treatment. In the same document an additional improvement is described where by the magnetic toner particles are removed from the printhead by using a much stronger magnetic field during the cleaning cycle than during the writing cycle.

In U.S. Pat. No. 4,755,837 an AC voltage is used for the backing electrode during the cleaning cycle. In a preferred embodiment the AC voltage on the back electrode is phase shifted by 180° if compared with the AC field (400 V peak to peak, no frequency disclosed) that is used upon the charged toner conveyor which is needed to obtain a high toner mist production, leading to high optical densities and short printing times. Further on the AC voltage can also have a certain DC-offset.

In U.S. Pat. No. 5,526,029 it is disclosed to use ionised air for blowing over the printhead so that the electrostatic interaction of the toner particles with the printhead is reduced and the toner particles are removed more easily from it than if compared with patent application WO-A 90 14959 where the air used is not pre-treated at all.

In EP-A-780 740 a printhead structure, for a DEP (Direct Electrostatic Printing) device is disclosed that comprises an insulating material, a slit, formed by two sides (SA and SB) of said insulating material, as printing apertures and control electrodes characterised in that only one of said two sides forming said slit carries control electrodes. In such a printhead structure the chance of clogging of the printing apertures is lower than in printhead structures wherein fine (maximum dimension around 400 $\mu$m) circular, elliptical, rectangular or square printing apertures are used.

In U.S. Pat. No. 5,625,392 an edge electrode is described so that instead of individual apertures or a larger slit as described in EP-A-780 740 an even larger free zone between the toner applicator and the receiver exists, resulting in even better properties regarding clogging of the printhead structure.

Said edge electrode system proposed in U.S. Pat. No. 5,625,392 suffers however from the drawback that, in order to obtain a good image contrast between image parts of low density and image parts of high density, the overall applied propulsion field between the toner applicator and the receiver on the back electrode must be set to a rather low value, leading to only a moderate printing speed.

In U.S. Pat. No. 5,374,949 an AC-field is superimposed upon the voltage applied to the individual control electrodes. Two different implementations have been described. In the first one image density is obtained if an AC-field is set between the toner delivery means and the back electrode while the control electrodes are kept at the ON-voltage. An additional AC-voltage can be applied to said control electrodes. In the second implementation said AC-voltage is applied to the control electrodes in the OFF-state. So it is described in said patent application that image density is regulated by switching over from a first DC-voltage to a second DC-voltage for said control electrodes, while on one of said DC-voltages an additional AC-voltage is superimposed.

Thus there is still a need for further improved DEP devices with enhanced printing speed and less clogging that are stable in time.

OBJECTS AND SUMMARY OF THE INVENTION

It is an object of the invention to provide a DEP device, i.e. a device for direct electrostatic printing that can print at high speed with low clogging of the control electrodes and with high maximum density and with a high degree of density resolution (i.e. for producing an image comprising a high amount of differentiated density levels) and spatial resolution.

A further object of the invention is to provide a DEP device that can be used with a wide variety of types of toner particles, and that can print at high speed with low clogging of the control electrodes, with high maximum density and with a printing quality that is constant over a long period of time.

Further objects and advantages of the invention ill become clear from the detailed description herein after.

The objects of the invention are realised by providing a device for direct electrostatic printing comprising a means for delivering charged toner particles, said means having a toner bearing surface coupled to a means for applying a first electric potential to said surface, a means for creating a flow of said charged toner particles away from said surface, a means for passing an image receiving substrate in said flow, a printhead structure having printing apertures and control electrodes, placed between said toner bearing surface and said image receiving substrate, leaving a gap (d) between said toner bearing surface and said control electrodes, characterised in that said control electrodes are coupled to a means for generating a first AC-field on said control electrodes and that a means for selectively switching said first AC-field on and off in accordance with image data is placed between said control electrodes and said means for generating said first AC-field for image-wise controlling said flow of toner particles.

The objects of the invention are further realised by providing a method for direct electrostatic printing comprising the steps of providing charged toner particles on a surface of a means for delivering toner particles, creating an electric potential difference between said surface and an image receiving substrate for creating a flow of charged toner particles towards said image receiving substrate from surface, interposing a printhead structure, with printing apertures and control electrodes in said flow of toner particles, for image-wise controlling said flow of toner particles, selectively switching an AC-field on and off, in accordance with image data, between said control electrodes and said toner bearing surface, depositing said image-wise controlled flow of toner particles on said image receiving substrate and fixing said toner particles to said substrate.

DEFINITIONS

Figure 1A:
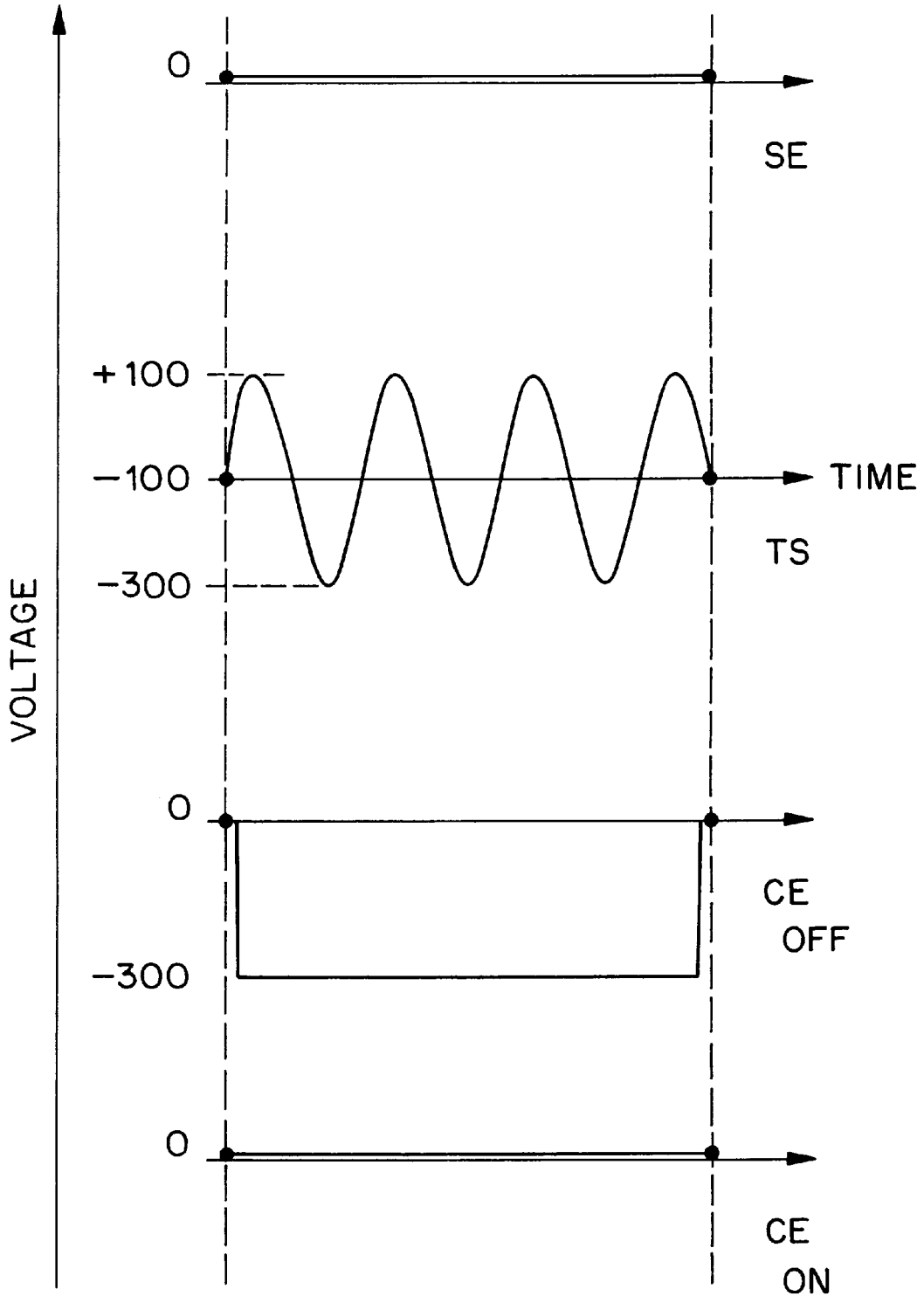
FIG. 1a PRIOR ART
FIGS. 1A, 1*b* and 1*c* show the electric potentials in DEP devices according to the prior art.

The wording "Toner bearing surface" is used in throughout this document to indicate the surface of the means for delivering toner particles from where a flow of toner particles to the image receiving substrate originates.

The wording "OFF-period" is used to indicate the time during which the control electrode is kept at an electric potential for blocking the passage of charged toner particles through the printing apertures controlled by said control electrode.

The wording "ON-period" is used to indicate the time during which the control electrode is kept at an electric potential for letting charged toner particles pass through the printing apertures controlled by said control electrode.

DETAILED DESCRIPTION OF THE INVENTION

It is known in the art of DEP (direct electrostatic printing), as described in the background art section above, that, in a DEP device, in a DC-field, a flow of charge toner particles is created between a means for delivering charged toner particles and an image receiving substrate. A printhead structure, having control electrodes around printing apertures, is interposed in said flow of toner particles for image-wise controlling said flow of toner particles. From the prior art disclosures, it becomes clear that the application of an AC-field to the surface of a means for delivering toner particles be used to increase the printing speed by providing a denser flow of toner particles in the vicinity of the printing apertures. This dense flow of toner particles from the surface bearing charged toner particles to a back electrode is a continuous flow, and this dense flow is image-wise modulated by putting a DC-voltage upon the control electrodes present in said printhead structure. Said DC-voltage either has a further propagating field (leading to image density) or a blocking field (leading to no-image density).

Levelling or reversing the propulsion field rapidly leads to toner adherence upon the printhead structure and to the wall of the printing apertures in the insulating material of the printhead structure, this leads to clogging of the printing apertures and thus to image artefacts and poor print quality, e.g., white dots or lines in even density patches due to the fact that some printing apertures are totally clogged. In most of the prior art disclosures, the flow of toner particles towards the printhead structure is a continuous one and the image-wise modulation is done by image-wise blocking the passage of the toner flow through printing apertures. The problems of clogging is in the prior art mainly addressed by means to relieve the clogging once it happened and not so much in ways to prevent the clogging.

It was surprisingly found that the flow of toner particles could image-wise be modulated by image-wise modulating an AC-field existing over the spacing between the toner bearing surface and the printing apertures. When no AC-field is formed between a particular control electrode around a printing aperture and the toner bearing surface, that printing aperture is totally blocked. When an AC-field is formed between a particular control electrode around a printing aperture and the toner bearing surface, that printing aperture lets charged toner particles pass in amounts related to the force of the electric AC-field. Grey levels can be printed by, e.g., time modulating the presence of the AC-field over the spacing between the toner bearing surface and the printing apertures.

This way of image-wise modulating the flow of charged toner particles, greatly reduced toner adhesion upon said printhead structure. It seems—without being bound by any theory—that by image-wise varying the presence of an AC-field over the spacing between the toner bearing surface and the printing apertures, the charged toner particles are no longer continuously flowing from the toner bearing surface to the control electrodes, where it is image-wise blocked in and freed from the printing apertures to print an image. It seems on the contrary that a kind of image-wise modulated flow of charged toner particles is generated when needed by image-wise applying an AC-field over the gap between the toner bearing surface and the printing apertures.

Therefore, the present invention includes a device for direct electrostatic printing comprising, apart from the usual components (i.e. means for creating a flow of toner particles from a toner bearing surface towards an image receiving member, a printhead structure with printing apertures and control electrodes interposed in said flow for image-wise controlling said flow), means for image-wise switching an AC-field over the gap the gap between the toner bearing surface and the printing apertures.

In the prior art devices for direct electrostatic printing, wherein an AC-field is present over the gap between the toner bearing surface and the control electrode, the AC-field is not image-wise changed and is always present. That AC-field, being always present, makes toner particles continuously flow from the toner bearing surface to and in the printing apertures, when an aperture has to be blocked, a DC-voltage largely different from the DC-voltage on the toner bearing surface is applied to block the passage of toner particles. In a DEP device (a device for Direct Electrostatic Printing) according to this invention an AC-field can be image-wise switched on and off, creating a flow of toner particles when needed, so that high resolution printing, even with pixels with dimensions around 100 $\mu$m, is possible.

Figure 1B:
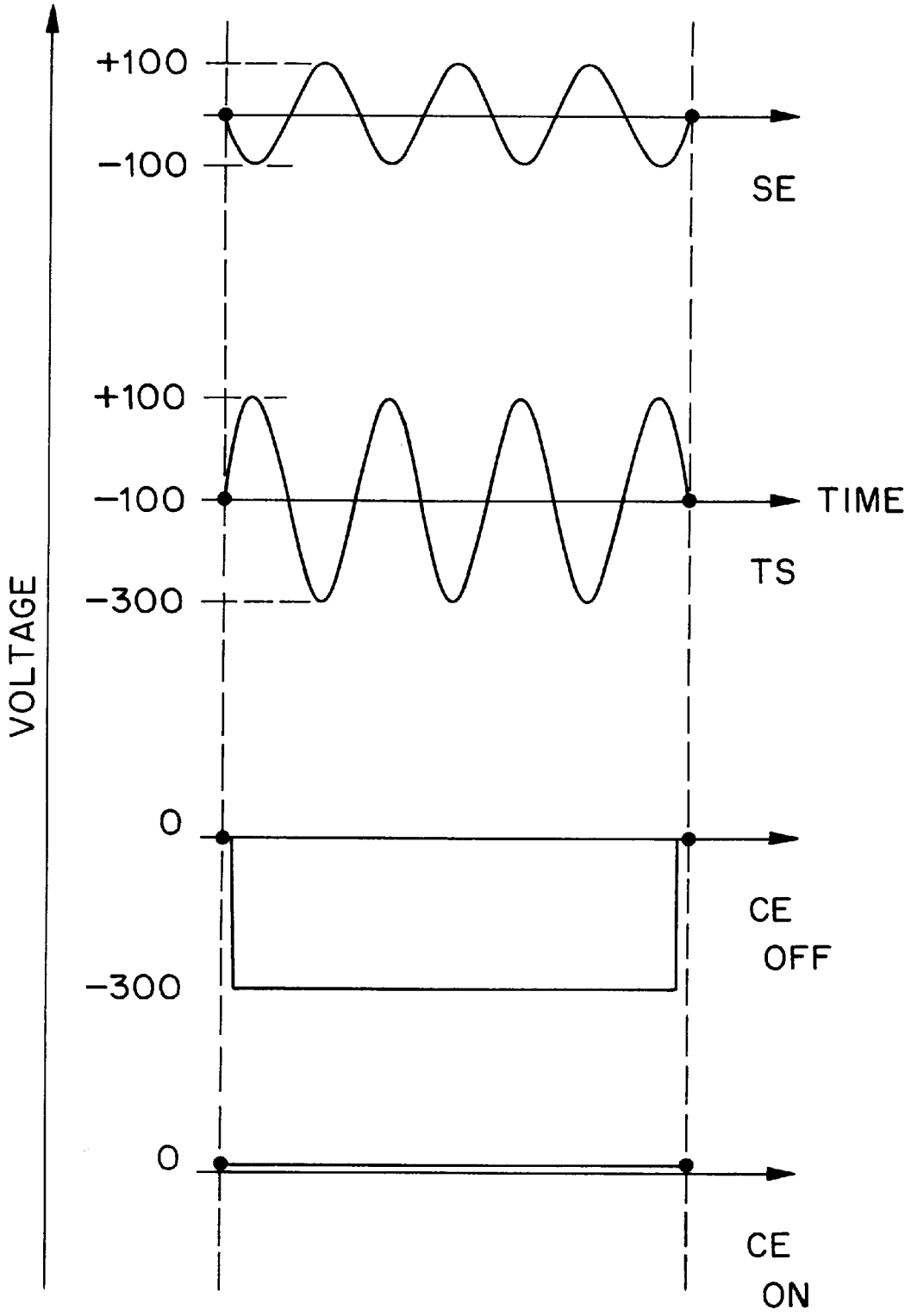
FIG. 1b PRIOR ART
Figure 1C:
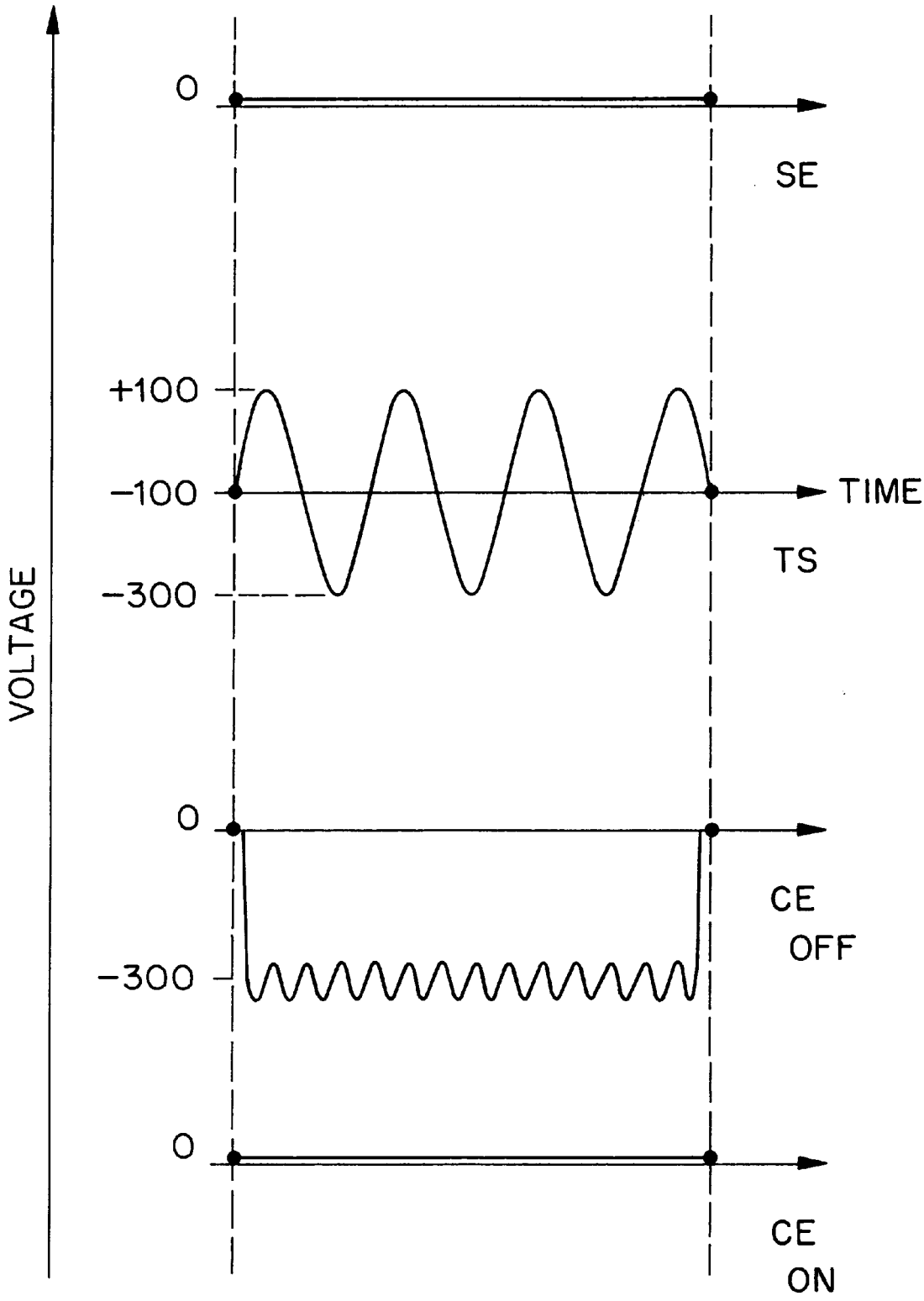
FIG. 1c PRIOR ART

In FIGS. 1*a*, 1*b* and 1*c* the electric potentials on the shield electrode (SE), the surface bearing the toner particles (TS) and the control electrode (CE) are shown for prior art DEP devices. The notation $CE_{OFF}$ designates the potential of the control electrode when the printing apertures blocks the flow of toner particles and $CE_{ON}$ the potential of the control electrode when the printing apertures lets the flow of toner particles pass uninfluenced. The X-axis in the figure show the line time (LT), i.e. the time necessary to print one line.

Throughout the text, the potentials on the shield electrode, on the control electrodes, on the toner bearing surface, etc., are given for DEP devices using negatively charged toner particles. It is obvious that, by changing the polarity of the potentials, the present invention also works with positively charged toner particles.

FIG. 1*a* shows the electric potentials for a DEP device as disclosed in U.S. Pat. No. 4,491,855. The shield electrode (SE) is kept at ground potential (i.e. 0 V, DC), the toner bearing surface is kept at a DC-potential −100 V, whereon an AC-potential with peak to peak voltage 400 V and a frequency $1/\lambda_1$ is applied. When the printing aperture is intended to stop the toner flow completely ($CE_{OFF}$), a DC voltage of −300 V is applied to the control electrode, when the printing aperture is intended to let the toner flow uninfluenced ($CE_{ON}$), a DC voltage of −0 V is applied to the control electrode, (i.e. the control electrode is grounded).

FIG. 1*b* shows the electric potentials for a DEP device as disclosed in U.S. Pat. No. 5,095,322. The shield electrode (SE) is kept at ground potential (i.e. 0 V, DC) whereon an AC-potential with peak to peak value of 200 V and frequency $1/\lambda_2$ is applied. The toner bearing surface is kept at a DC-potential −100 V, whereon an AC-potential with peak to peak voltage 400 V and a frequency $1/\lambda_1$ is applied. Both AC-voltages are 180 degrees out of phase. When the printing aperture is intended to stop the toner flow completely ($CE_{OFF}$), a DC voltage of −300 V is applied to the control electrode, when the printing aperture is intended to let the toner flow uninfluenced ($CE_{ON}$), a DC voltage of −0 V is applied to the control electrode, (i.e. the control electrode is grounded).

FIG. 1*c* shows the electric potentials for a DEP device as disclosed in U.S. Pat. No. 5,374,949. The shield electrode (SE) is kept at ground potential (i.e. 0 V, DC). The toner bearing surface is kept at a DC-potential −100 V, whereon an AC-potential with peak to peak voltage 400 V and a frequency $1/\lambda_1$ is applied. When the printing aperture is intended to stop the toner flow completely ($CE_{OFF}$), a DC voltage of −300 V is applied to the control electrode and on this DC voltage a small AC-voltage (e.g., 20 V peak to peak) with frequency $1/\lambda_3$ is applied. When the printing aperture is intended to let the toner flow uninfluenced ($CE_{ON}$), a DC voltage of −0 V is applied to the control electrode, (i.e. the control electrode is grounded). Since the AC-voltage applied on the control electrodes in the OFF-period is very small compared to the DC-voltage and to the AC-voltage on the toner bearing surface, (see FIG. 4*c* of U.S. Pat. No. 5,374,949), there is both during the OFF-period and the ON-period an AC-field present over the gap between the toner bearing member and the control electrode.

Figure 2:
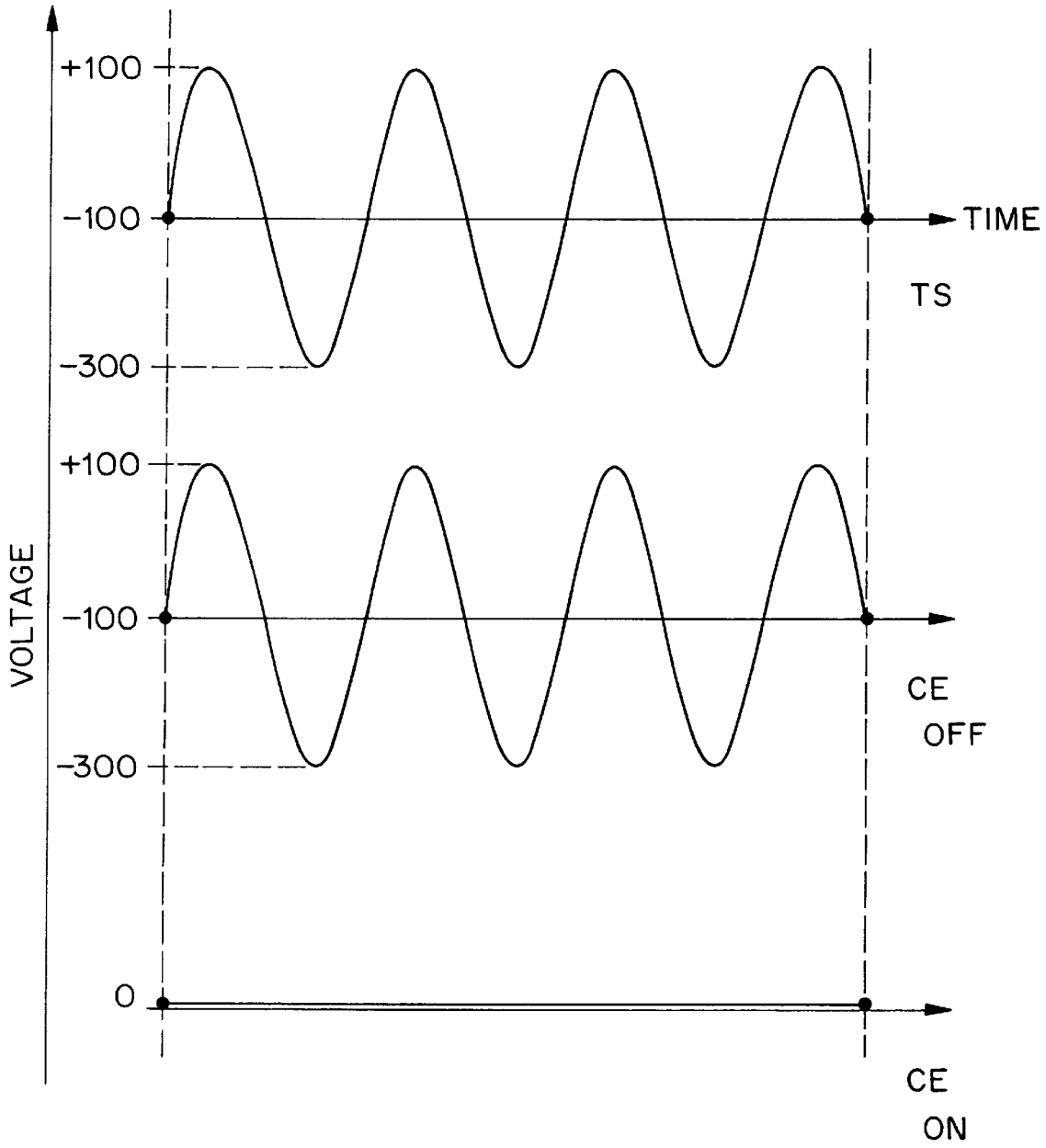
FIG. 2 shows the electric potentials in a DEP device according to a first embodiment of the invention.

FIG. 2 shows the electric potentials for an embodiment of a DEP device according to this invention. The device according to this invention can comprise a shield electrode, then, the shield electrode (SE) is preferably kept at ground potential (i.e. 0 V, DC). The device can also be operated without shield electrode, therefore the figure only shows the potentials on the toner bearing surface (TS) and the potential of the control electrode when the printing apertures blocks the flow of toner particles ($CE_{OFF}$) and the potential of the control electrode when the printing apertures lets the flow of toner particles pass uninfluenced ($CE_{ON}$). The toner bearing surface is kept at a DC-potential −100 V, whereon an AC-potential with peak to peak voltage 400 V and a frequency $1/\lambda_1$ is applied. When the printing aperture is intended to stop the toner flow completely ($CE_{OFF}$), a DC voltage of −100 V is applied to the control electrode and an AC-potential with peak to peak voltage 400 V and a frequency $1/\lambda_1$ is applied on top of said DC-potential. The AC voltage on the toner bearing surface and on the control electrode are in phase. Thus the AC-field on the control electrode and the AC-field on the tone bearing surface balance each other out and no AC-field exists over the gap between the toner bearing surface and the control electrodes when the printing aperture has to block the toner flow. When the printing aperture is intended to let the toner flow uninfluenced ($CE_{ON}$), a DC voltage of −0 V is applied to the control electrode, (i.e. the control electrode is grounded). Thus, an AC-field exists over the gap between the toner bearing surface and the control electrodes when the printing aperture has to let toner particles pass freely.

Figure 3:
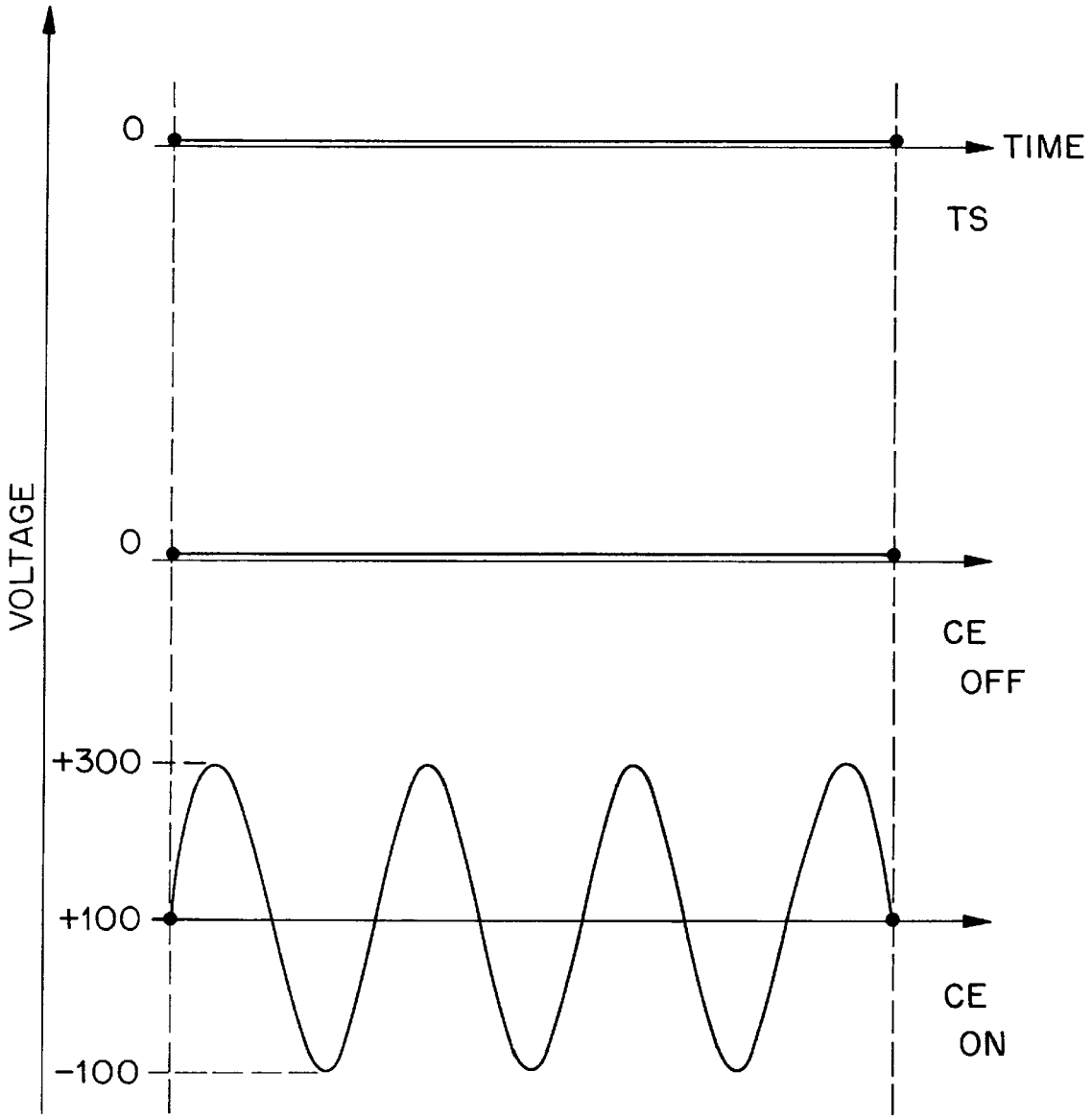
FIG. 3 shows the electric potentials in a DEP device according to a second embodiment of the invention.

FIG. 3 shows the electric potentials for an other embodiment of a DEP device according to this invention. The device according to this invention can comprise a shield electrode, then, the shield electrode (SE) is preferably kept at ground potential (i.e. 0 V, DC). The device can also be operated without shield electrode, therefore the figure only shows the potentials on the toner bearing surface (TS) and the potential of the control electrode when the printing apertures blocks the flow of toner particles ($CE_{OFF}$) and the potential of the control electrode when the printing apertures lets the flow of toner particles pass uninfluenced ($CE_{ON}$). The toner bearing surface is kept at a DC-potential of 0 V (i.e. it is grounded). When the printing aperture is intended to stop the toner flow completely ($CE_{OFF}$), a DC voltage of 0 V is applied to the control electrode, and again no AC-field exists over the gap between the toner bearing surface and the control electrodes when the printing aperture has to block the toner flow. When the printing aperture is intended to let the toner flow uninfluenced ($CE_{ON}$), an DC voltage of +100 V is applied to the control electrode, on top of which an AC-potential with peak to peak voltage 400 V and a frequency $1/\lambda_1$ is applied. Again, an AC-field exists over the gap between the toner bearing surface and the control electrodes when the printing aperture has to let toner particles pass freely.

Thus in DEP devices according to the present invention the toner flow is completely blocked when no AC-field is present over the gap between the toner bearing surface and the control electrode that is strong enough to displace charged toner particles over that gap into the printing aperture controlled by that control electrode. Thus, DEP device wherein during the OFF-period of a control electrode (the period wherein the control electrode blocks the printing aperture that it controls) a weak AC-field is present over the gap between the toner bearing surface and the control electrode, is within the scope of this invention even when, due to that AC-field, charged toner particles are indeed detached from the toner bearing surface, but do not travel into the printing aperture.

Grey levels can then be printed by bringing the control electrode and the toner bearing surface only a fraction of the line time (LT) to the same electric potential, thus blocking the toner flow for only a fraction of the line time (LT). This time modulation is a preferred embodiment of the present invention. It is possible, for increasing the number of grey levels that can be printed, to have a DC-voltage on the control electrodes deviating from the DC-voltage on the toner bearing surface and/or to have an AC-voltage on the control electrodes deviating from the AC-voltage on the toner bearing surface. Thus it is possible to choose the strength of the AC-field over the gap between the toner bearing surface and the control electrodes such that so that, e.g. not $D_{max}$ is formed, but only three quarter of $D_{max}$., half of $D_{max}$, a quarter of $D_{max}$, etc. By combining a time modulation with a modulation of the strength of the AC-field, it is possible to print a higher number of density levels, than when using time-modulation alone or using the modulation of the strength of the AC-field alone.

Figure 4:
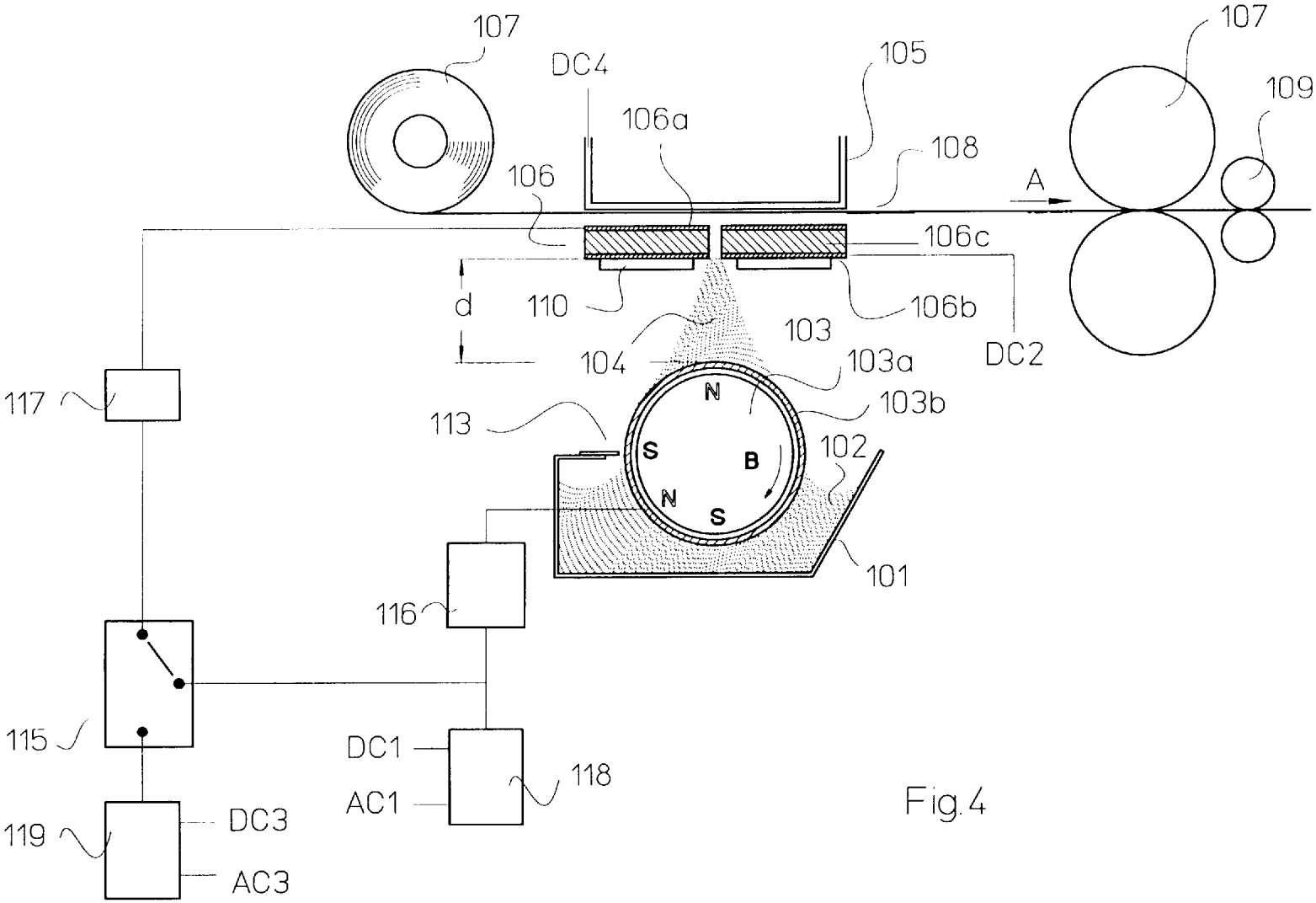
FIG. 4 shows a DEP device according to a first embodiment of the invention.

In FIG. 4 a DEP device according to the present invention is shown. In this device the electric potentials on the different parts of the device are taken as described above in the first embodiment of the invention.

The DEP device shown comprises means for delivering toner particles with a container (101)for developer (102) wherein a magnetic brush (103) having a core (103*a*) wherein magnets are present and a sleeve (103*b*) rotatably mounted around the core is present. The developer (102) can be a mono component developer with magnetic toner particles and then on the surface of the sleeve of the magnetic brush, toner particles are present, i.e. the surface of the sleeve (103*b*) of the magnetic brush is the toner bearing surface. The developer (102) can also be a multi-component developer containing magnetic carrier particles and non-magnetic toner particles and then on the sleeve of the magnetic brush carrier and toner particles are present, but the sleeve is still the toner bearing surface in the sense of this invention. The magnetic brush (103) can have a fixed core (103*a*) and a sleeve (103*b*) rotatably mounted around the core equipped with means for rotating the core. In another embodiment, the core (103*a*) of the magnetic brush is also equipped with means for rotating the core and can thus also be rotated and the sleeve (103*b*) can be rotated around the core or kept stationary. (The means for rotating the core and/or the sleeve are not shown in the figure). The part of the magnetic brush that rotates, does so in the direction of arrow B. A device (118)for generating a DC-voltage and an AC-voltage is connected to the sleeve of the magnetic brush and applies a DC-voltage (DC1) and an AC-field (AC1) to said sleeve (the toner bearing surface). Between said device for generating DC1 and AC1 and the toner bearing surface, optionally a further means for providing a DC and/or AC-potential (116) to the toner bearing surface may be present. The amount of developer on the toner bearing surface is regulated by a doctor blade (113).

The device, as shown, further comprises a back electrode (105) connected to a DC voltage source applying a voltage DC4 to the back electrode. An image receiving substrate (108) is passed by means for moving the substrate (107) in the direction of arrow A between the printhead structure (106) and the back electrode by conveying means (107). The difference between voltage DC4 and voltage DC1 applies a DC-propulsion field wherein a flow of toner particles (104) is created from the sleeve of the magnetic brush (the toner bearing surface) to the image receiving substrate on the back electrode. The AC-field (AC1) on the sleeve of the magnetic brush makes the flow (104)of toner particles denser than when no AC-field would be present.

A printhead structure (106), with an insulating material (106*c*) carrying control electrodes (106*a*) is interposed in the flow (104) of toner particles. The control electrodes (106*a*) can selectively be connected, over switch (115) either to a device (119) for generating a DC-voltage (DC3) and an AC-field (AC3) or to said device (118) for generating a DC-voltage (DC1) and an AC-voltage (AC1). Between said device for applying a DC-voltage (DC3) and an AC-field (AC3) to the control electrode, optionally a further means for providing a DC and/or AC-potential (117) to the control electrode may be present.

By image-wise modulating the electric potential applied by switch (115) to the control electrodes, the flow of charged toner particles is image-wise modulated in the vicinity of the control electrodes. The voltage applied to the control electrodes can be varied between a value totally blocking the passage of the toner particles (i.e. when switch 115 connects the control electrodes to when DC1 and AC1). The toner flow passes totally unimpeded when AC3=0 and DC3=0 (i.e. when the control electrode is grounded). In a preferred embodiment of the invention, the control electrode is grounded for printing full density through the printing aperture it controls and the grey levels are printed by time modulating the switching of a switch (115) between the devices providing DC3 and AC3 and the devices providing DC1 and AC1. In the simplest implementation no device (119) for generating a DC-voltage (DC3) and an AC-field (AC3) is incorporated, and the switch (115) switches the control electrode between the device (118) connected to the toner bearing surface and the ground. It is possible, as described above, to apply a DC-voltage (DC3) having a value different from DC1 and/or an AC-field (AC3) having a value different from the AC-field (AC1) to the control electrode, for partially blocking the printing apertures and at the same time again time modulating the switching of switch 115. By doing so, the number of grey levels that can be printed can be enhanced. In a simple implementation The control electrodes in said printhead structure are placed apart from the toner bearing surface, leaving a gap (d) between the control electrodes and the toner bearing surface; a spacer (110) keeps the gap (d) constant during operation of the device.

The device comprises further means (109) for fixing the toner particles to the image receiving substrate.

Figure 5:
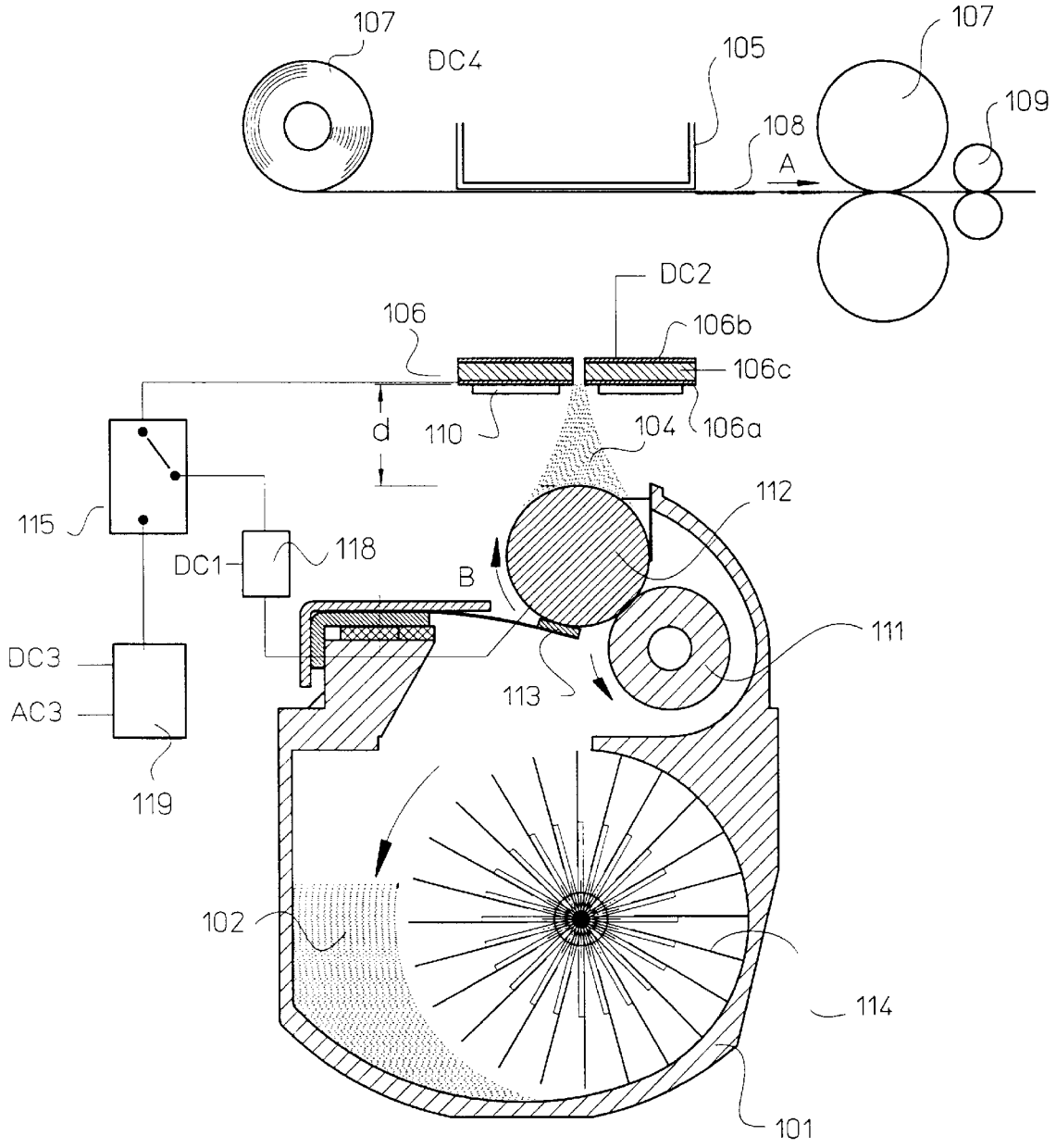
FIG. 5 shows a DEP device according to a second embodiment of the invention.

In FIG. 4, the toner bearing surface is the surface of the sleeve of a magnetic brush, in FIG. 5 a device according to a further embodiment of the invention is shown, wherein the toner bearing surface is the surface of an applicator carrying toner particles derived from a non-magnetic mono-component developer.

The device, shown in FIG. 5 is the same as the one shown in FIG. 4, except for the toner bearing surface, so only the numericals different from those used in FIG. 1 will be described. In a container (101) for non magnetic mono component developer a roller (112) is present, having a surface. On this surface toner particles are applied by means of a feeding roller (111) made of porous foamed polymers. A developer mixing blade (114) mixes and transports said non-magnetic mono-component developer towards said feeding roller. A doctor blade (113) regulates the thickness of the charged toner particles upon the surface said roller (112), i.e. on the toner bearing surface.

In the DEP device shown in FIG. 4 only a device (118) only generating a DC-potential (DC1) is connected to the sleeve of the toner bearing surface. The control electrodes (106*a*) can over a switch 115 selectively be connected to a device (119) providing an AC-field (AC3) and a device providing a DC-voltage (DC3) or to the device (118) providing a DC-voltage (DC1) on the toner bearing surface. The DC potential (DC3) and the AC-field (AC3) are image-wise modulated in order to modulate the toner flow through the control electrodes. The voltage applied to the control electrodes can be varied between a value totally blocking the passage of the toner particles when the switch (115) connects the control electrode to the device (118) providing a DC-voltage (DC1), and a value leaving the toner flow pass totally unimpeded when the switch (115) connects the control electrode to the device (119) providing a DC-voltage (DC3)and an AC-field (AC3). Intermediate settings of DC3 and AC3 make it again possible, as described above, to increase the number of grey levels that can be printed.

In the FIGS. 4 and 5 the toner bearing surface is the surface of the sleeve of a magnetic brush (in FIG. 4), or the surface of an applicator for non-magnetic mono-component developer (in FIG. 5). A DEP device according to this invention can also be equipped with a charged toner conveyer (CTC) on the surface of which charged toner particles are applied by a magnetic brush or an applicator for non-magnetic mono-component developer. In this case the toner bearing surface is the surface of the CTC and the means for applying the AC-field (AC1), are connected to that surface.

The control electrodes can be coupled to a means for generating an AC-field on said control electrodes and a means for selectively switching said AC-field on and off in accordance with image data, as in this invention, in any DEP device known in the art. Typical DEP devices that can be adapted for producing a device according to this invention are disclosed in, e.g., EP-A-795 802, EP-A-780 740, EP-A-740 224, EP-A-731 394, EP-A-712 055, U.S. Pat. No. 5,606,402, U.S. Pat. No. 5,523,777, GB-A-2 108 432, U.S. Pat. No. 4,743,926, etc.

The insulating material, used for producing printhead structure, useful in a DEP device according to the present invention, can be glass, ceramic, plastic, etc. Preferably said insulating material is a plastic material, and can be a polyimide, a polyester (e.g. polyethylelene terephthalate, polyethylene naphthalate, etc.), polyolefines, an epoxy resin, an organosilicon resin, rubber, etc.

The selection of an insulating material for the production of a printhead structure useful in a DEP device according to the present invention, is governed by the elasticity modulus of the insulating material. Insulating material, useful in the present invention, has a elasticity modulus between 0.1 and 10 GPa, both limits included, preferably between 2 and 8 GPa and most preferably between 4 and 6 Gpa. The insulating material has a thickness between 25 and 1000 $\mu$m, preferably between 50 and 200 $\mu$m.

The back electrode (105) of a DEP device according to this invention, can also be made to co-operate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, co-operating with the printhead structure, can also comprise one or more flexible PCB's (Printed Circuit Board).

The present invention incorporates the operation of a DEP device according to the present invention in a method for direct electrostatic printing comprising the steps of:

providing charged toner particles on a surface of a means for delivering toner particles, creating an electric potential difference between said surface and an image receiving substrate for creating a flow of charged toner particles towards said image receiving substrate from surface, placing a printhead structure, with printing apertures and control electrodes in said flow of toner particles, leaving a gap (d) between said toner bearing surface and said control electrodes, selectively switching an AC-field on and off, in accordance with image data, over said gap (d) between said toner bearing surface and said control electrodes, for image-wise controlling said flow of toner particles, depositing said image-wise controlled flow of toner particles on said image receiving substrate and fixing said toner particles to said substrate.

A DEP device according to the present invention can also be operated without back electrode in a method for DEP printing on an insulating image receiving substrate, having a first and a second face, comprising the steps of:

applying a conductive layer upon said first face of said insulating substrate, connecting said conductive layer by conductive charge applying device to a voltage source providing a first DC-potential on said substrate, providing charged toner particles on a surface of a means for delivering toner particles, creating an electric potential difference between said surface and an image receiving substrate for creating a flow of charged toner particles towards said image receiving substrate from surface, placing a printhead structure, with printing apertures and control electrodes in said flow of toner particles, leaving a gap (d) between said toner bearing surface and said control electrodes, selectively switching an AC-field on and off, in accordance with image data, over said gap (d) between said toner bearing surface and said control electrodes, for image-wise controlling said flow of toner particles, depositing said image-wise controlled flow of toner particles on said image receiving substrate and fixing said toner particles to said substrate.

A method for direct electrostatic printing operating without back electrode has been disclosed in EP-A-823 676.

A DEP device according to the present invention can further be operated in a method for direct electrostatic printing with reduced banding comprising the steps of:

creating a DC-potential difference between an image receiving substrate and a magnetic brush assembly having a rotatably mounted core and a sleeve rotatably mounted around said core;

rotating said core at a rotational speed equal to or higher than 500 rotations per minute and rotating said sleeve at a rotational speed equal to or lower than 10 rotations per minute;

applying a developer with toner particles and magnetically attractable carrier particles on said magnetic brush assembly;

creating a flow of toner particles directly from said magnetic brush assembly to said image receiving substrate;

interposing a printhead structure, carrying control electrodes in said flow of toner particles, placing a printhead structure, with printing apertures and control electrodes in said flow of toner particles, leaving a gap (d) between said toner bearing surface and said control electrodes, selectively switching an AC-field on and off, in accordance with image data, over said gap (d) between said toner bearing surface and said control electrodes, for image-wise controlling said flow of toner particles, depositing said image-wise controlled flow of toner particles on said image receiving substrate and fixing said toner particles to said substrate.

In this method the core is preferably kept stationary. A method and device for direct electrostatic printing wherein the toner bearing surface is the sleeve of a magnetic brush with a rotating core, has been described in EP-A-827 046.

In a DEP device, according to the present invention, operating in the methods described above, and wherein the surface of the sleeve of the magnetic brush is used as toner bearing surface, (i.e. the toner flow originates directly from the surface of the sleeve of the magnetic brush), any type of known carrier particles and toner particles can successfully be used. It is however preferred to use "soft" magnetic carrier particles. "Soft" magnetic carrier particles useful in a DEP device according to a preferred embodiment of the present invention are soft ferrite carrier particles. Such soft ferrite particles exhibit only a small amount of remanent behaviour, characterised in coercivity values ranging from about 4 up to 20 kA/m (from 50 up to 250 Oe). Further very useful soft magnetic carrier particles, for use in a DEP device according to a preferred embodiment of the present invention, are composite carrier particles, comprising a resin binder and a mixture of two magnetites having a different particle size as described in EP-B-289 663. The particle size of both magnetites will vary between 0.05 and 3 μm. The carrier particles have preferably an average volume diameter ($d_{v50}$) between 10 and 300 μm, preferably between 20 and 100 μm. More detailed descriptions of carrier particles, as mentioned above, can be found EP 675 417, that is incorporated herein by reference.

It is preferred to use in a DEP device according to the present invention, toner particles with an absolute average charge (|q|) corresponding to 1 fC<|q|<20 fC, preferably to 1 fc<|q|<10 fC. The absolute average charge of the toner particles is measured by an apparatus sold by Dr. R. Epping PES-Laboratorium D-8056 Neufahrn, Germany under the name "q-meter". The q-meter is used to measure the distribution of the toner particle charge (q in fC) with respect to a measured toner diameter (d in 10 μm). From the absolute average charge per 10 μm (|q|/10 μm) the absolute average charge |q| is calculated. Moreover it is preferred that the charge distribution, measured with the apparatus cited above, is narrow, i.e. shows a distribution wherein the coefficient of variability (ν), i.e. the ratio of the standard deviation to the average value, is equal to or lower than 0.33. Preferably the toner particles used in a device according to the present invention have an average volume diameter ($d_{v50}$) between 1 and 20 μm, more preferably between 3 and 15 μm. More detailed descriptions of toner particles, as mentioned above, can be found in EP-A-675 417. In fact any toner known in the art can be used in a DEP-device according to this invention, it can be toners produced by a pulverisation process, a polymerisation process, a coagulation process, etc. Very good toner particles for use in any DEP device and thus also for use in a DEP device according to this invention, are toner paticles as described in U.S. Pat. No. 5,633,110. In that disclosure the use in DEP of toner particles having as topological criterium that the ratio of the length of the long axis of the projected microscopic image of said particles to the length of the short axis is between 1.00 and 1.40, said ratio being the average of the ratios measured on at least 20 different toner particles and said toner particles after addition of 0.5% by weight of fumed hydrophobic silica having a specific surface area of 260 $m^2/g$ show a ratio of apparent density ($\rho_{app}$) over real density ($\rho_{real}$)

$$\frac{\rho_{app}}{\rho_{real}} > 0.52.$$

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the AC and/or DC-voltage applied on the control electrodes 106*a* and/or by a time modulation of said AC an/or DC-voltage. By changing the duty cycle of the time modulation at a specific frequency, it is possible to print accurately fine differences in grey levels. It is also possible to control the grey level printing by a combination of an amplitude modulation and a time modulation of the voltages, applied on the control electrode.

The combination of a high spatial resolution and of the multiple grey level capabilities typical for DEP, opens the way for multilevel halftoning techniques, such as e.g. described in EP-A-634 862 with title "Screening method for a rendering device having restricted density resolution". This enables the DEP device, according to the present invention, to render high quality images.

EXAMPLES

Example 1

The printhead structure.

A printhead structure (106) was made from a polyimide film of 50 μm thickness (106*c*), double sided coated with a 5 μm thick copper film. The printhead structure (106) had two rows of printing apertures. On the back side of the printhead structure, facing the receiving member substrate, a rectangular shaped control electrode (106*a*) was arranged around each aperture. Each of said control electrodes was connected over 2 MΩ resistors to a HV 507 (trade name) high voltage switching IC, commercially available through Supertex, USA, that was powered from a high voltage power amplifier. On the back side of the printhead structure, facing the back electrode, a common shield electrode (106*b*) was present. The printing apertures were rectangular shaped with dimensions of 200 by 100 μm. The total width of the rectangular shaped copper control electrodes and connecting lines was 80 μm. The width of the aperture in the common shield electrode was 1600 μm. Said printhead structure was fabricated in the following way. First of all the control electrode pattern and shield electrode pattern was etched by conventional copper etching techniques. The apertures were made by a step and repeat focused excimer laser making use of the control electrode patterns as focusing aid. After excimer burning the printhead structure was cleaned by a short isotropic plasma etching cleaning. Finally a thin coating of PLASTIK70, commercially available from Kontakt Chemie, was applied over the control electrode side of said printhead structure.

The toner delivery means

The toner delivery means was a commercially available toner cartridge comprising non magnetic mono component developer, the COLOR LASER TONER CARTRIDGE MAGENTA (M3760GIA), for the COLOR LASER WRITER (Trade names of Apple Computer, USA). The toner bearing surface is the surface of an aluminium roller (112), whereon tone particles are applied by a feeding roller (111) The toner particles carried a negative charge.

The printing engine

The printhead structure, mounted in a PVC-frame (116), was bent with frictional contact over the surface of the roller of the toner delivery means. The 50 μm thick polyurethane coating was used as self-regulating spacer means (110).

A back electrode was present behind the paper whereon the printing proceeded, the distance between the back electrode (105) and the back side of the printhead structure (i.e. control electrodes (106*a*)) was set to 1000 μm and the paper travelled at 200 cm/min.

The back electrode was connected to a high voltage power supply, applying a voltage DC4 of +1000 V to the back electrode. To the toner bearing surface of the toner delivery means a sinusoidally changing AC voltage (AC1) with 400 V peak to peak and a frequency of 3 kHz was applied and a DC-offset (DC1) of −100 V. The DC-propulsion field, i.e. the potential difference between DC4 and DC1, was 1100 V. To the individual control electrodes an (image-wise-selected) voltage was applied selected from 0 V (printing a pixel of maximum density) or the same voltage as applied to the toner delivery means (DC1 and AC1 with the same amplitude and phase as the voltages applied to the toner bearing surface: printing a pixel with minimum density). Grey scale images of a human face and control wedges from maximum to minimum density were printed during several minutes after which the image quality and toner accumulation upon said printhead structure was observed. Said printing example showed extremely good results.

Comparative Example

The same experiment was done as described in example 1 except that pixels with maximum density were created by putting 0 V upon the control electrodes, while pixels of minimum density were created by putting −280 V upon said control electrodes. In contrast to example 1 already after having printed a few images, "lost lines" of white density were observed in the printouts and toner accumulation upon said printhead structure could be easily observed. In the wedges also the band of maximum density showed different white lines that only disappeared after printing for a certain time at maximum density.

Example 2

The same experiment as described in example 1 was repeated except that the toner delivery means was grounded and to the control electrodes a sinusoidally changing AC-field of 400 V (peak to peak) with −100 V DC offset (3 kHz) was used for pixels of maximum image density while only 0 V DC was used for pixels of minimum image density. Compared to example 1 only one AC signal was necessary and phase shifting compared to the AC applied towards the toner bearing surface, due to the capacitance of the different control electrodes, could not interfere. The maximum image density was lowered to 90% compared with example 1 but no missing lines nor toner accumulation upon said printhead structure could be observed.

What is claimed is:

1. In a device for direct electrostatic printing on a substrate having a source of toner particles, a printhead structure having apertures and control electrodes associated with said apertures, a first voltage source connected to establish a flow of toner particles from said toner source to said substrate and a second voltage source for providing a control voltage between said toner source and said control electrodes to control said toner flow in accordance with image data to be printed, the improvement wherein said second voltage source provides a first AC field between said toner source and said control electrode to permit said toner flow and a second, diminished AC field between said toner source and said control electrode to stop said toner flow.

2. The improvement specified in claim 1 wherein said second voltage source is time-modulated between said first and second fields according to said image data.

3. The improvement as specified in claim 1 wherein said second voltage source provides said first AC field between said toner source and said control electrode by applying an AC voltage to said toner source and a DC voltage to said control electrode, and wherein said second voltage source provides said second, diminished AC field between said toner source and said control electrode by providing an AC voltage to said toner source and an in-phase AC voltage to said control electrode.

4. The improvement specified in claim 3 wherein said AC voltage applied to said toner source has a peak-to-peak voltage between 200 v. and 600 v.

5. The improvement specified in claim 1 wherein said second voltage source provides said first AC field between said toner source and said control electrode by applying an AC voltage to said toner source and a DC voltage to said control electrode, and wherein said second voltage source provides said second, diminished AC field between said toner source and said control electrode by providing a DC voltage to said toner source and a DC voltage to said control electrode.

6. The improvement specified in claim 5 wherein said DC voltage applied to said control electrode is ground.

* * * * *